US006517902B2

(12) United States Patent
Drake et al.

(10) Patent No.: US 6,517,902 B2
(45) **Date of Patent: *Feb. 11, 2003**

(54) METHODS OF TREATING PREFORM ELEMENTS

(75) Inventors: Eric F. Drake, Pearland, TX (US); Harold A. Sreshta, Houston, TX (US); Nigel Dennis Griffin, Whitminster (GB)

(73) Assignee: Camco International (UK) Limited (GB)

( * ) Notice: Subject to any disclaimer, the term of this patent is extended or adjusted under 35 U.S.C. 154(b) by 67 days.

This patent is subject to a terminal disclaimer.

(21) Appl. No.: 09/827,672

(22) Filed: Apr. 6, 2001

(65) Prior Publication Data

US 2001/0049019 A1 Dec. 6, 2001

Related U.S. Application Data

(63) Continuation of application No. 09/443,536, filed on Nov. 19, 1999, now abandoned, which is a continuation-in-part of application No. 09/114,640, filed on Jul. 13, 1998, now Pat. No. 6,056,911.

(30) Foreign Application Priority Data

May 27, 1998 (GB) ..... 9811213

(51) Int. Cl.[7] ..... C23C 16/27
(52) U.S. Cl. ..... 427/249.8; 427/249.13
(58) Field of Search ..... 427/249.8, 249.13

(56) References Cited

U.S. PATENT DOCUMENTS 5,111,895 A * 5/1992 Griffin ..... 175/425
5,190,796 A 3/1993 Iacovangelo
5,309,000 A 5/1994 Saito et al.
5,523,121 A 6/1996 Anthony et al.
5,529,805 A * 6/1996 Iacovangelo et al. ..... 427/249
5,614,140 A 3/1997 Pinneo
5,626,909 A 5/1997 Iacovangelo
6,056,911 A * 5/2000 Griffin ..... 264/346
6,116,360 A * 9/2000 Evans ..... 175/371

FOREIGN PATENT DOCUMENTS

EP 0 550 763 A1 7/1993
EP 0 589 641 A2 3/1994
GB 2 021 154 A 11/1979
GB 2 158 101 A 11/1985
GB 2 275 690 A 9/1994

OTHER PUBLICATIONS

Patent Abstract of Japan: Publication No.—03219079; Publication Date, Sep. 26, 1991; Inventor: Sakurai Keiichi.
Patent Abstract of Japan: Publication No.—05209274; Publication Date, Aug. 20, 1993; Inventor: Masuda Atsuhiko.
Diamond and Related Materials, vol. 6, No. 1 (Jan. 1, 1997); pp 89–94; titled: "High Quality Diamond Films on WC–Co Surfaces," by M.B. Guseva, V. GF. Babaev; V.V. Khvostov, G.M. Lopez Ludena, A. Yu. Bregadze, I.Y. Konyashin, A.E. Alexenko.

* cited by examiner

*Primary Examiner*—Bret Chen
(74) *Attorney, Agent, or Firm*—Jeffery E. Daly

(57) ABSTRACT

A method of thermally treating a preform element, of the kind having a facing table of polycrystalline diamond bonded to a substrate of cemented tungsten carbide, comprises the steps of: (a) heating the element to a soaking temperature of 550–625° C., and preferably about 600° C., (b) maintaining the element at that temperature for at least one hour, and (c) cooling the element to ambient temperature. The resulting preform element has a substrate with a cobalt binder including a substrate interface zone with at least 30 percent by volume of the cobalt binder a hexagonal close packed crystal structure. This reduces the risk of cracking or delamination of the element in use.

10 Claims, 3 Drawing Sheets

METHODS OF TREATING PREFORM ELEMENTS

CROSS-REFERENCE TO RELATED APPLICATION

This is a Continuation of U.S. patent application No. 09/443,536, filed Nov. 19, 1999, by Eric F. Drake, Harold Sreshta and Nigel D. Griffin now abandoned, which is Continuation-in-Part of U.S. patent application No. 09/114,640, filed Jul. 13, 1998, by Nigel D. Griffin, entitled "Methods of Treating Preform Elements" now U.S. Pat. No. 6,056,911.

BACKGROUND OF THE INVENTION

1. Field of the Invention

The invention relates to preform elements comprising a facing table of polycrystalline diamond bonded to a substrate of less hard material, such as cemented tungsten carbide.

2. Background of the Invention

Preform elements of this kind are used as cutting elements in rotary drag-type drill bits, and formation-engaging inserts on roller cone and percussive bits. The present invention is particularly applicable to the treatment of such preform elements before they are mounted on the drill bit, although the invention is not restricted to elements for this particular use. Alternatively, preform elements of the kind referred to may be employed in workpiece-shaping tools, high pressure nozzles, wire-drawing dies, bearings and other parts subject to sliding wear, including bearing elements subject to percussive loads such as tappets, cams, cam followers, and similar devices requiring wear-resistant surfaces.

Preform elements of the kind to which the invention relates are generally manufactured by pre-forming a substrate in an appropriate shape from compacted powdered material, applying one or more layers of diamond particles to the surface of the substrate, and then densifying the substrate and diamond layer(s) to form an integral unit. Densification is achieved via a high pressure, high temperature process in a forming press so that the diamond particles bond together and to the substrate by a sintering mechanism. Diamond-to-diamond bonding occurs during densification, producing a polycrystalline diamond composite layer bonded to the substrate. Such elements are commonly referred to as PDC (polycrystalline diamond compact) inserts. High temperature, high pressure manufacturing processes for production of PDC elements are well known and will not be described in detail.

In drag-type drill bits, each preform cutting element may be mounted on a carrier in the form of a generally cylindrical stud or post received in a socket in the body of the drill bit. The carrier is usually formed from cemented tungsten carbide, the surface of the substrate being brazed to a surface on the carrier, for example by a process known as "LS bonding". In the LS bonding process, the diamond facing layer is cooled while the substrate is brazed to the carrier, to avoid heating of the polycrystalline diamond facing table above about 725° C., beyond which threshold graphitization and internal fracture reactions can degrade properties. Since high-strength braze filler metals typically entail melting temperatures in excess of this stability threshold, cooling of the preform element is normally required for braze bonding. In some types of cutters for drag-type drill bits, and also in some types of inserts for roller cone bits, the substrate of the preform element is of sufficient axial length that the substrate itself may be secured directly within a socket in the bit body or in a roller cone.

Preform elements used in drill bits are subject to high service temperatures and high contact and bending loads, leading to possible substrate cracking, or spalling or delamination of the polycrystalline diamond facing table. These modes of degradation can cause the separation and loss of diamond from the facing table. In particular, failures are often localized at the interface between the diamond table and substrate. Similar fracture processes are observed in preform elements subjected to repetitive percussive loading, as in tappets and cam mechanisms. Residual stresses arising in the preform element due to forming, brazing, and/or fitting processes are believed to significantly influence the tendency for cracking, spalling and delamination progressions. It has become common practice to heat-treat the preform elements after formation in the press and before mounting on the bit body, in an attempt to reduce or modify residual stresses in the element, and thereby reduce the tendency of the elements to crack or delaminate in use.

One common method of heat treatment for thermal stress relief is to maintain the preform elements at temperatures of up to 500° C. for periods of up to 48 hours. However, while this is believed to have some stress-modifying effect, subsequent cracking and delamination of the preform elements are still frequently observed in service.

SUMMARY OF THE INVENTION

The present invention provides a preform element having a facing table of polycrystalline diamond bonded to a substrate of cemented tungsten carbide with a cobalt binder. The substrate includes an interface zone with at least 30 percent by volume of the cobalt binder in a hexagonal close packed crystal structure.

The present invention also provides a new form of heat treatment for preform elements, which provides more effective thermal stress management, and also reduces the time cycle for manufacturing each element. According to a first aspect of the invention there is provided a method of treating a preform element having a facing table of polycrystalline diamond bonded to a substrate of less hard material, the method comprising the steps of:

(a) heating the element to a soaking temperature in the range of 550–700° C., (b) maintaining the temperature of the element in said range for a period of at least one hour, and (c) cooling the element to ambient temperature.

The substrate may be composed of a cemented tungsten carbide composite, that is to say tungsten carbide particles in a binder phase. The method of this invention, where the temperature of the element is maintained above 550° C. for at least an hour, causes microstructural changes within the binder phase near the substrate-diamond table interface which accommodate stress relaxation between the diamond table and the cemented carbide substrate. Reduction of peak internal stress levels increases the threshold loading needed to nucleate and growth crack defects, effectively toughening or increasing the tolerance of preform elements to severe service loading.

In step (a), the temperature of the element may raised to a value in the range of 550–625° C., and preferably in the range of 575–620° C. In a most preferred embodiment, the temperature of the element is raised to about 600° C.

The temperature of the element may be maintained in said range for a period of about one hour, or for a period of at least two hours, depending on the nature of the preform element. In some special cases, it may be advantageous to maintain the temperature of the element in the stipulated range for periods of up to 18 or 36 hours.

In the heating step (a), the temperature of the element is preferable raised to the soaking temperature gradually, for a period in the range of one half to one and a half hours, typically for a period of about one hour.

Steps (a) and (b) are preferably conducted in a non-oxidizing atmosphere.

In the cooling step (c), the temperature of the element is preferably reduced from the soaking temperature gradually, for a period in the range of three to four hours. For example, the element may be allowed to cool gradually to about 200° C., then rapidly cooled to ambient temperature.

The method and/or the preform element may be applied to preform cutting elements for rotary drag-type drill bits, where the facing table of the preform element has a substantially flat front face, a peripheral surface, and a rear surface bonded to the front surface of the substrate.

The method and/or the preform element are also applicable to inserts for roller cone bits, where the facing tables of the preform element comprise a range of generally convex shapes. Such shaped facing tables of the preform element may comprise a plurality of polycrystalline diamond layers.

The method according to this first aspect of the invention will reduce the tendency toward substrate cracking and delamination. However, in some cases both of these failure progressions may be further inhibited by subjecting the element to a second, flash heating, step.

According to a second aspect of the invention, therefore, there is provided a method of treating a preform element having a facing table of polycrystalline diamond bonded to a substrate of less hard material, the method comprising a first step of:

(a) heating the element to a soaking temperature in the range of 550–700° C., (b) maintaining the temperature of the element in said range for a period of at least one hour, and (c) cooling the element to ambient temperature, followed by the second step of:

(d) heating the element to a temperature above 725° C., (e) maintaining the temperature of the element above 725° C. for a period not exceeding five seconds, and (f) cooling the element to ambient temperature.

It will be noted that in the second step of the heat treatment the element is heated to a temperature which is greater than the temperature at which the polycrystalline diamond will normally experience degradation due to graphitization or other mechanism. However, according to this aspect of the invention, the temperature is raised above this critical temperature for only a very short period, no more than five seconds. It is found that the activation energy resulting from such brief overheating of the diamond layer is insufficient to initiate graphitization of the diamond, but is sufficient to cause stress-altering plastic deformations which greatly toughens the preform element.

The first steps (a), (b) and (c) of the heat treatment may have any of the parameters referred to above in relation to the first aspect of the invention. Steps (d) and (e) may also be conducted in a non-oxidizing atmosphere.

Preferably in step (d) the element is heated to a temperature above 750° C., but below about 850° C.

In step (e) the temperature of the element is preferably maintained above 725° C. for a period of about four seconds.

The second part of the method, i.e. the steps (d), (e) and (f), may also be advantageous if used alone, without the preceding steps, to relieve residual stress in a preform element.

Accordingly, therefore, the invention also provides a method of treating a preform element having a facing table of polycrystalline diamond bonded to a substrate of less hard material, the method comprising the steps of heating the element to a temperature above 725° C., maintaining the temperature of the element above 725° C. for a period not exceeding five seconds, and then cooling the element to ambient temperature.

BRIEF DESCRIPTION OF THE DRAWINGS

The following is a more detailed description of embodiments of the invention, reference being made to the accompanying drawings in which.

DETAILED DESCRIPTION OF THE PREFERRED EMBODIMENT

Figure 1:
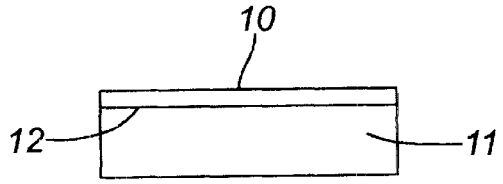
FIG. 1 is a diagrammatic sectional view of a typical preform element for use as a cutting element in a rotary drag-type drill bit.

Referring to FIG. 1, a typical preform cutting element for a drag-type rotary drill bit comprises a thin facing table 10 of polycrystalline diamond bonded to a substrate 11 of cemented tungsten carbide. When used as cutters in rotary drag-type drill bits, such elements are often in the form of circular or part-circular tablets although other shapes are possible. In FIG. 1 the interface 12 between the facing table 10 and substrate 11 is shown as flat but it is also common practice to preform the substrate 11 so as to provide an interface which is non-planar and configured, thereby providing some mechanical interlocking between the facing table and substrate. Also, there may be provided a transition layer between the facing table and substrate, such transition layer having characteristics intermediate those of the facing table and substrate. For example, the coefficient of thermal expansion (CTE) of the substrate material is substantially greater than that of the facing table. A transition layer would be designed with an intermediate CTE so as to distribute thermal strains over a wider region, thereby reducing the peak stresses which arise during heating and cooling of the element.

Figure 2:
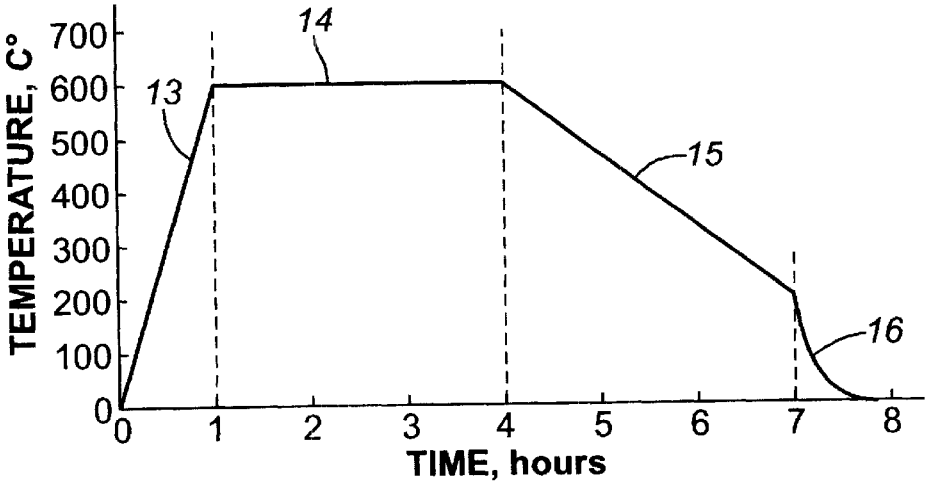
FIG. 2 is a graph representing a typical stabilization cycle of the heat treatment according to the present invention.

FIG. 2 shows a typical stabilization heating cycle comprising steps (a) to (c) of the present invention. This graph plots temperature against time, showing gradual heating of the preform element over a period of one hour in the first part of the cycle (13), to a temperature of 600° C. In some special cases, it may be advantageous to maintain the temperature of the element in the stipulated range for periods of up to 18 or 36 hours. The second portion of the cycle (14) comprises a hold at 600° C. for about two hours. In the final portions of the cycle, the element is cooled to about 200° C. over a period of about three hours (15) and then rapidly cooled to ambient temperature (16). Although this example uses a target stabilization temperature of 600° C., different types of perform elements may be optimally stabilized at other temperatures in the range of 550–700° C.

Figure 3:
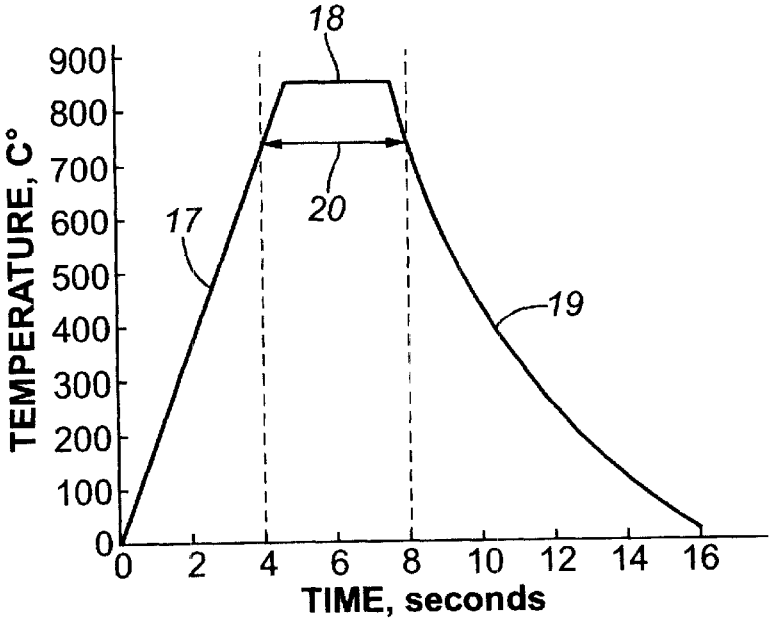
FIG. 3 is a graph illustrating a flash heating cycle of the treatment according to the present invention.

The element of the preceding example may also be subsequently "flash" heat-cycled as shown in the graph of FIG. 3. In this cycle, the element is heated rapidly (17) to a temperature above 750° C., for example about 850° C. It is held for short period (18), and cooled rapidly to ambient temperature (19). This cycle results in a duration above 750° C. of about four seconds (20).

Preferably, the heating in the stabilization cycle and/or in the flash heating cycle is conducted in a non-oxidizing atmosphere. The flash heating cycle illustrated in FIG. 3 may be effected by induction, laser, or other heating means. The temperature of the element may be determined by an infrared temperature sensing device. The flash heating cycle may also be used for stress modification of the preform element without a preceding stabilization heating cycle.

The efficacy of thermal stabilization treatments for residual stress modification of preform elements has been characterized by neutron diffraction stress measurement. Stabilization by the exemplary process described in FIG. 2 caused a 37% decrease in the average residual stress in the diamond table and corresponding reductions of peak residual stress levels in the substrate.

The methods according to the invention are also applicable to the heat treatment of PDC inserts for use in roller cone drill bits. Such PDC inserts may differ in several respects from elements optimized for drag-type drill bits including shape, PDC layer number and formulation, and cemented carbide substrate composition. For example, the facing table of a PDC enhanced roller cone insert may have a generally convex front face and concave rear surface bonded to a corresponding convex substrate surface.

Figure 4:
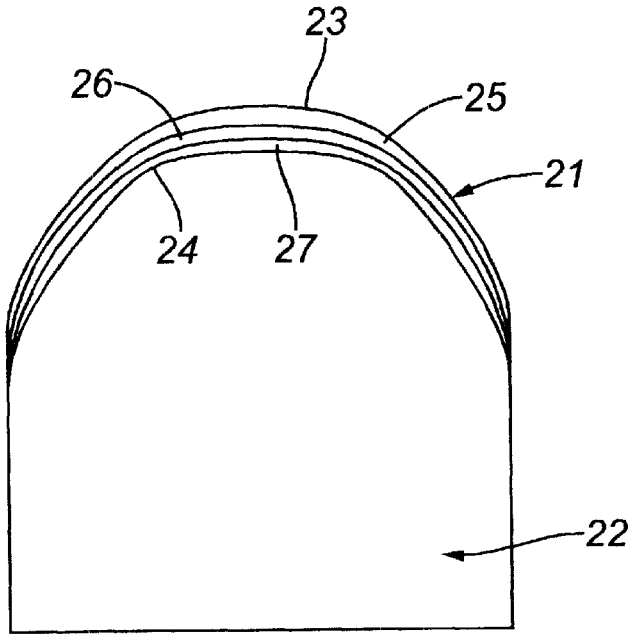
FIG. 4 is a diagrammatic sectional view of a domed preform element for use as an insert on a roller cone drill bit.

FIG. 4 is a diagrammatic section through a typical domed preform element for use as an insert on a roller cone drill bit. The insert comprises a three layer facing table 21, incorporating polycrystalline diamond, bonded to a substrate 22 of cemented tungsten carbide. The facing table 21 of the insert has a generally convexly domed front face 23, and a generally concave rear surface 24 bonded to a generally convexly domed front surface of the substrate 22.

The layers in the facing table 21 may be of suitable compositions, the particulars of which do not form a part of the present invention. However, in an exemplary type of insert the outermost layer 25 comprises a high proportion of polycrystalline diamond, about 83% by weight, the balance being tungsten carbide and cobalt. The intermediate layer 26 comprises about 55% by weight polycrystalline diamond and 36% by weight tungsten carbide, the balance being cobalt. The innermost layer 27 of the facing table comprises about 30% by weight polycrystalline diamond and 62% by weight tungsten carbide. The substrate 22 comprises mostly tungsten carbide with about 6% by weight of a cobalt binder.

The shape and composition of the insert shown in FIG. 4 are by way of example only and the invention is applicable to roller cone bit inserts of this general type, but of other shapes of the element and other compositions of the substrate and the diamond facing table.

The differences between shaped PDC inserts and preform cutting elements for rotary drag-type drill bits, of the general kind shown in FIG. 1, influence residual stress development and response to stress modification via heat treatment. Accordingly, the parameters for heat treatment of roller-cone bit inserts according to the present invention may differ from the particular parameters suitable for stress modification in preform cutting elements for drag-type drill bits.

Figure 5:
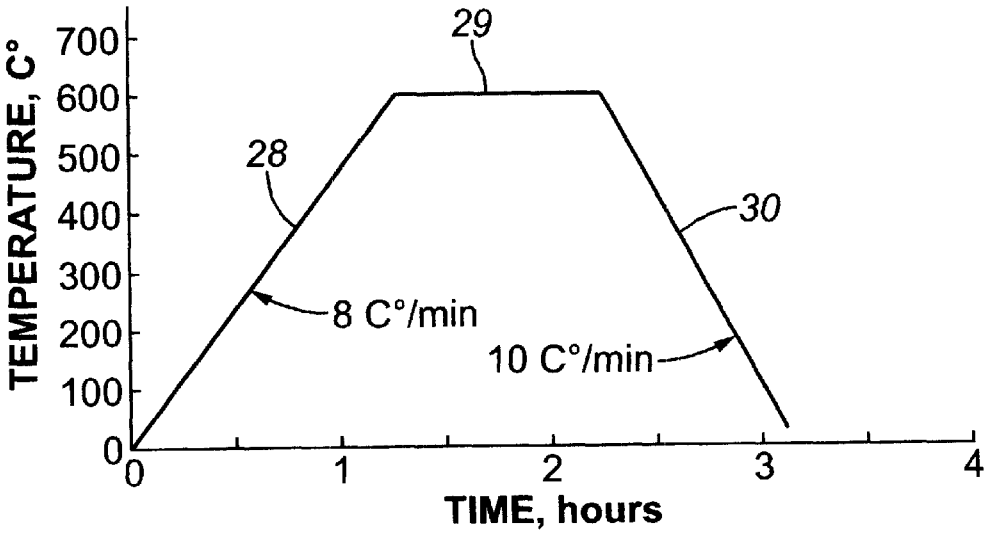
FIG. 5 is a graph representing a stabilization cycle for the heat treatment of an insert of the kind shown in FIG. 4.

In particular, it has been found that round-top PDC inserts for roller cone bits, when stabilized at 600° C. for one hour, exhibit a dramatic increase in average spalling threshold when compared with inserts which have not been thermally treated. FIG. 5 shows a typical stabilization heating cycle comprising steps (a) to (c) of the present invention, suitable for inserts of the kind shown in FIG. 4. This graph plots temperature against time, showing gradual heating of the preform element over a period of about 70 minutes in the first part of the cycle (28) to a temperature of 600° C. The second portion of the cycle (29) comprises a hold at 600° C. for one hour. In the final portions of the cycle, the element is cooled at about 10° C./min to ambient temperature (30). Although this example uses a target stabilization temperature of 600° C., different types of PDC inserts may be optimally stabilized at other temperatures in the range of 550–700° C. However, for the some types of PDC inserts tested, stabilization above about 650° C. was associated with spontaneous cracking of the diamond table.

Figure 6:
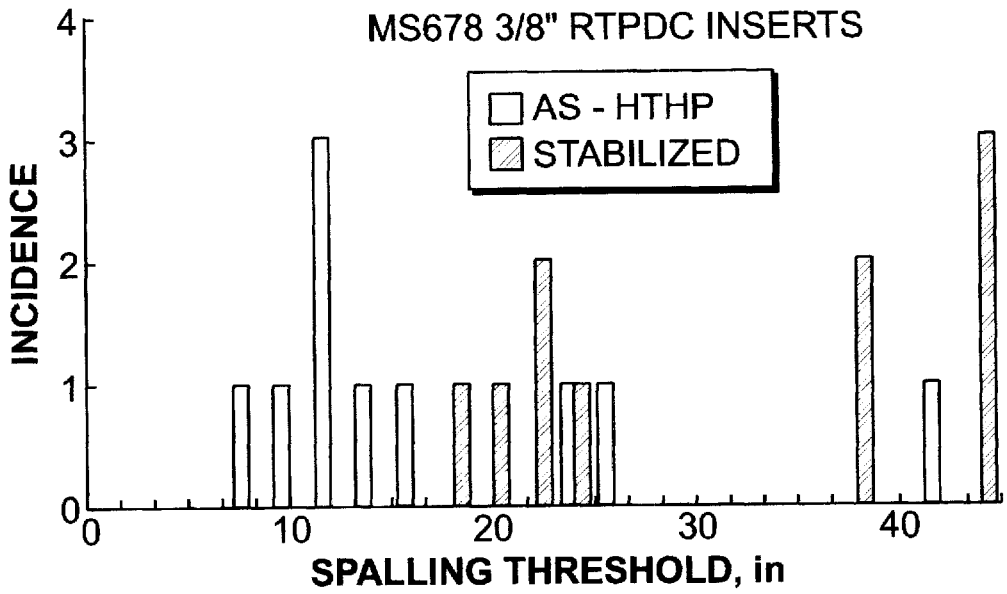
FIG. 6 is a graph showing the increase in spalling threshold of inserts after stabilization.
Figure 7:
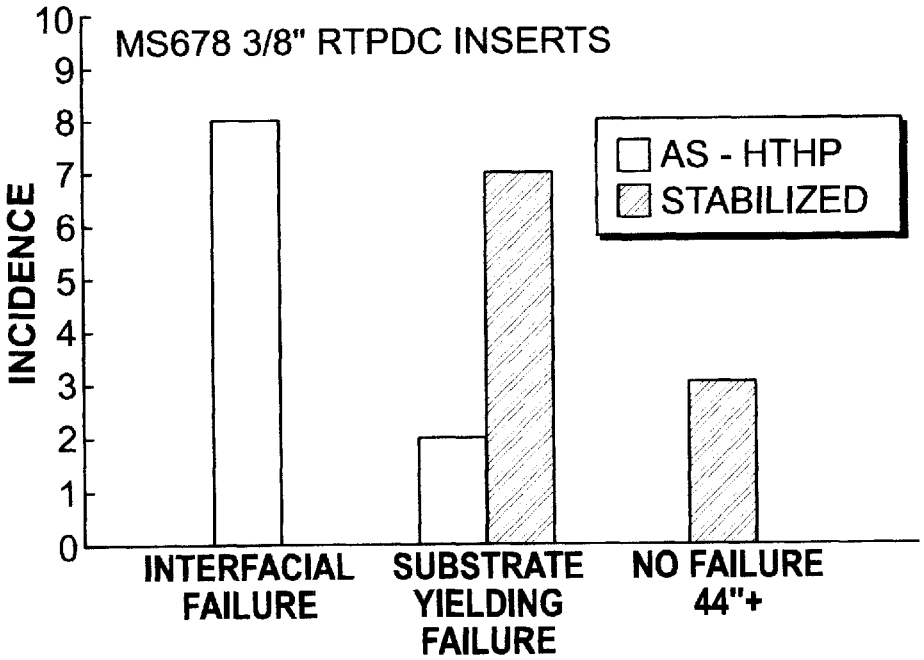
FIG. 7 is a graph illustrating the change in failure modes of inserts after stabilization.

The efficacy and mechanism of thermal stabilization treatments for PDC inserts has been characterized by analytical testing including drop tests, metallography, x-ray fluorescence chemical analyses, x-ray diffraction crystallographic analyses, and fracture mode categorization. Round-top PDC inserts stabilized by the example procedure showed a two times increase in minimum spalling threshold. As shown in FIG. 6, the distribution was similarly shifted with 30% of the population exhibiting no failure at the maximum impact energy. In addition, the stabilization treatment altered failure modes from interfacial cracking to substrate yielding, as shown in FIG. 7.

No microstructural changes due to the heat stabilization treatment were apparent in the interface zone when evaluated by optical metallography at 1500 magnification. The substrate interface zone is defined as the region of the substrate bounded by the termination of the last diamond-containing layer and the isopleth corresponding to a depth of about 0.002 inches to about 0.020 inches and typically about 0.010 inch. EDS X-ray chemical analysis scans conducted in the interface zone revealed only tungsten, cobalt, and carbon with detectable no impurity elements.

X-ray diffraction results from the same interface region showed that structural changes occurred in the cobalt binder phase during stabilization. In the as-sintered substrate, the cobalt binder comprises mainly metastable face-centered cubic (FCC) phase with limited amounts, less than 20 percent by volume, of hexagonal close packed (HCP) phase, and reflects lattice dilation (peak shifts) due to tungsten solution. After high-temperature/high-pressure processing to produce the PDC-coated insert, the binder fraction in the interface region of the substrate is substantially reduced, but retains its previous FCC crystal structure. However, after stabilization the cobalt binder is found to have substantially transformed to the HCP form in the interface zone, while the remainder of the binder in the substrate retains its previous FCC structure. The structural transformation of the interface region of the substrate is thought to occur by a shear mechanism that provides stress re-distribution between the diamond layer(s) and the cemented carbide substrate. Transformation of the cobalt binder structure in the interface zone to a minimum 30 volume percent of HCP is considered effective in increasing the toughness of the preform elements. However, transformations to structures comprising from 80 volume percent to approaching 100 volume percent HCP in the interface zone are possible.

In summary, it was found that stabilization of the PDC inserts at 600° C. for one hour creates an interfacial substrate layer comprising HCP cobalt binder. The creation of this layer is triggered thermally under the influence of interfacial residual shear stresses, relaxing residual stress levels in throughout the insert produced during high-temperature, high-pressure (HTHP) processing. The result is an increase in the impact resistance of the PDC inserts, and a change in overload failure mode from interfacial cracking to substrate yielding leading to circumferential spalling or radial splitting. The interfacial failure mode was observed only on unstabilized parts i.e. inserts not subjected to heat treatment according to the invention, and was associated with low impact energies. When yielding failure occurred in parts from the unstabilized group, it was associated with high impact energies. These correlations suggest that stabilization changes the interface zone physically in several ways which raise the stress threshold for crack nucleation.

Whereas the present invention has been described in particular relation to the drawings attached hereto, it should be understood that other and further modifications, apart from those shown or suggested herein, may be made within the scope and spirit of the present invention.

What is claimed is:

1. A method of treating a preform element having a facing table of polycrystalline diamond bonded to a substrate of cemented tungsten carbide, the method comprising the steps of:

(a) heating the element to a soaking temperature in the range of 550–700° C., (b) maintaining the temperature of the element in said range for a period of at least eighteen hours, and (c) cooling the element to ambient temperature.

2. A method according to claim 1 wherein, in the heating step (a), the temperature of the element is raised to the soaking temperature, for a period in the range of one half to one and a half hours.

3. A method according to claim 1, wherein, in step (a), the temperature of the element is raised to a value in the range of 550–625° C.

4. A method according to claim 1, wherein, in step (a), the temperature of the element is raised to a value in the range of 575–620° C.

5. A method according to claim 1, wherein, in step (a), the temperature of the element is raised to about 600° C.

6. A method according claim 1, wherein the facing table of the preform element has a substantially flat front face, a peripheral surface, and a rear surface bonded to a front surface of the substrate.

7. A method according to claim 1, wherein the facing table of the preform element has a domed front face, and a rear surface bonded to a domed front surface of the substrate.

8. A method according to claim 6, where the facing table of the preform element comprises a plurality of layers of polycrystalline diamond.

9. A method according to claim 1, wherein at least steps (a) and (b) are effected in a non-oxidizing atmosphere.

10. A method according to claim 1, wherein in step (b) the temperature of the element is maintained for a period of at least thirty-six hours in a non-oxidizing atmosphere.

* * * * *